US005131329A

United States Patent [19]

Lips et al.

[11] Patent Number: 5,131,329

[45] Date of Patent: Jul. 21, 1992

[54] ERAGMENTATION PROJECTILE

[75] Inventors: Hendrik Lips, Düsseldorf; Herbert Weisshaupt, Aachen; Hans Orth, Düsseldorf, all of Fed. Rep. of Germany

[73] Assignee: Rheinmetall GmbH, Düsseldorf, Fed. Rep. of Germany

[21] Appl. No.: 622,640

[22] Filed: Dec. 5, 1990

[30] Foreign Application Priority Data

Dec. 7, 1989 [DE] Fed. Rep. of Germany ..... 3940462

[51] Int. Cl.[5] ..... F42B 12/24; F42B 12/44

[52] U.S. Cl. ..... 102/364; 102/493

[58] Field of Search ..... 102/6, 493, 496, 364, 102/491, 494, 495

[56] References Cited

U.S. PATENT DOCUMENTS

| | | | |
|---|---|---|---|
| 3,000,309 | 9/1961 | Zapf | 102/493 |
| 3,566,794 | 3/1971 | Pearson et al. | 102/493 |
| 3,799,054 | 3/1974 | LaRocca | 102/491 |
| 3,820,464 | 6/1974 | Dixon | 102/493 |
| 4,089,267 | 5/1978 | Mescall et al. | 102/491 |
| 4,106,411 | 8/1978 | Borcher et al. | 102/495 |
| 4,381,692 | 5/1983 | Weintraub | 102/364 |
| 4,745,864 | 5/1988 | Craddock | 102/491 |
| 4,870,884 | 10/1989 | Schubart et al. | 102/364 |
| 4,989,493 | 5/1991 | Bloomer et al. | 102/374 |
| 5,054,399 | 10/1991 | Bilek et al. | 102/491 |

FOREIGN PATENT DOCUMENTS

| | | | |
|---|---|---|---|
| 1812462 | 10/1969 | Fed. Rep. of Germany | 102/491 |
| 2339386 | 1/1975 | Fed. Rep. of Germany . | |
| 9454818 | 7/1913 | France | 102/394 |

*Primary Examiner*—Michael J. Carone

*Attorney, Agent, or Firm*—Spencer, Frank & Schneider

[57] ABSTRACT

A fragmentation projectile having at least two adjacent casings including an inner casing having an inner surface and an outer surface, and at least one outer casing substantially surrounding the outer surface of the inner casing. An explosive charge is disposed within the inner casing, and an incendiary mass is disposed on the inner surface of the inner casing and facing the explosive. Structured zones are defined on the inner casing and include regions of lesser wall thickness than the portions of the inner casing surrounding the regions to cause a shock wave generated when the explosive charge is detonated to be transferred locally into the at least one outer casing to produce fragments of a predetermined size and shape.

15 Claims, 3 Drawing Sheets

ERAGMENTATION PROJECTILE

BACKGROUND OF THE INVENTION

The invention relates to a fragmentation projectile of the type having at least an inner casing or shell for receiving an explosive charge, an outer casing or shell, and structured zones provided in an inner casing for determining the geometry of the fragments when the explosive charge detonates.

This type of fragmentation projectile is known, for example, from U.S. Pat. No. 3,000,309. In this prior art projectile, the side facing the explosive of the interior shell is designed in such a wa that the explosive gases are able to attack locally and the local effects of shaped charges can be utilized. A primary disadvantage of that prior art arrangement is that it requires a very elaborate shell structure and is, consequently, very expensive.

German Auslegeschrift (published examined application) DE 2,339,386 discloses, in its FIG. 2, a fragmentation projectile comprising a plurality of projectile shells as well. However, in this case, the fragmentation shell and the zirconium shell, which causes the incendiary effect, are separate bodies.

These prior art projectiles have the disadvantage that no directional fragmentation effect is provided; rather, the fragment distribution approximates cylindrical symmetry. Furthermore, the effectiveness of the light zirconium fragments, especially at greater target distances, is questionable, given the negligible penetration effect of these fragments.

U.S. Pat. No. 4,089,267 discloses a fragmentation projectile in which, to increase the number of fragments, the explosive is enclosed by two shells. A gap, which is filled with a low-density material, such as air or foam, must be present between the two shells. Subsequent to ignition of the explosive, the interior shell presses forcefully and suddenly against the exterior shell, resulting in a relatively high fragment formation. The disadvantage of that prior art projectile is the fact that a great number of undefined fragments are formed. As a result, no reproducible distribution of fragments is possible.

SUMMARY OF THE INVENTION

It is an object of the present invention to further develop a fragmentation projectile, using U.S. Pat. No. 3,000,309 as a point of departure, so that the actual fragmentation shell is particularly easy to produce and, in addition, a desired incendiary effect, for example, for attacking aircraft fuel tanks, results.

This object is achieved by the present invention in which a fragmentation projectile has an explosive enclosed by at least two projectile shell bodies with the shell or casing closest to the explosive, i.e., the inner casing, being provided with predetermined structured zones. The structured zones are the basis on which the projectile produces reproducible fragments during detonation, and comprise predetermined regions of lesser wall thickness than the portions of the shell or casing enclosing the structured zones. In that manner the shock wave generated by the detonation is transferred locally set off in time and thus imparts the intended fragment shape. An incendiary mass is disposed on the side or surface of the inner casing that faces the explosive.

According to one preferred embodiment of the invention the structured zones are arranged on the side or surface of the inner casing that faces away from the explosive. Moreover, the inner casing having the structured zones has a substantially lower impedance $\rho \cdot c$ in comparison with the adjacent exterior shell, where $\rho$ represents the density of the respective material and c the speed of the shock wave generated in the respective material by the detonation. The fragmentation projectiles according to the invention can have a steel inner casing which is provided with structured zones, and the adjacent outer shell or casing can be tungsten or a tungsten heavy metal alloy.

In general, the basis of the invention is the concept of optimizing fragmentation and incendiary effects of a projectile by having the structured zones of an inner (interior) shell comprise regions of lesser wall thickness than the portions of the inner shell enclosing the structured zones. The wall thicknesses, shell materials, and the number of shells determine the shape and mass distribution of the fragments and can, depending on the intended use, be matched optimally to the target requirements.

The present invention does not exhibit the disadvantage of conventional fragmentation warheads in which the pyrophorous incendiary mass accompanies the fragments to the target, and in which the relatively small fragments immediately sink into the fluid to be ignited and, as a result, are extinguished. Rather, given the use of multiple casings in the projectile according to the invention a plurality of fragments fly to the target in a staggered fashion, ahead of the fragments accompanying the incendiary mass, and prepare the targeted fuel for optimal ignition by means of the cavitation bubbles arising on entry of the initial fragments therein or by means of the spreading out of the fuel by the initial fragments.

DETAILED DESCRIPTION OF THE PREFERRED EMBODIMENTS

Figure 1:
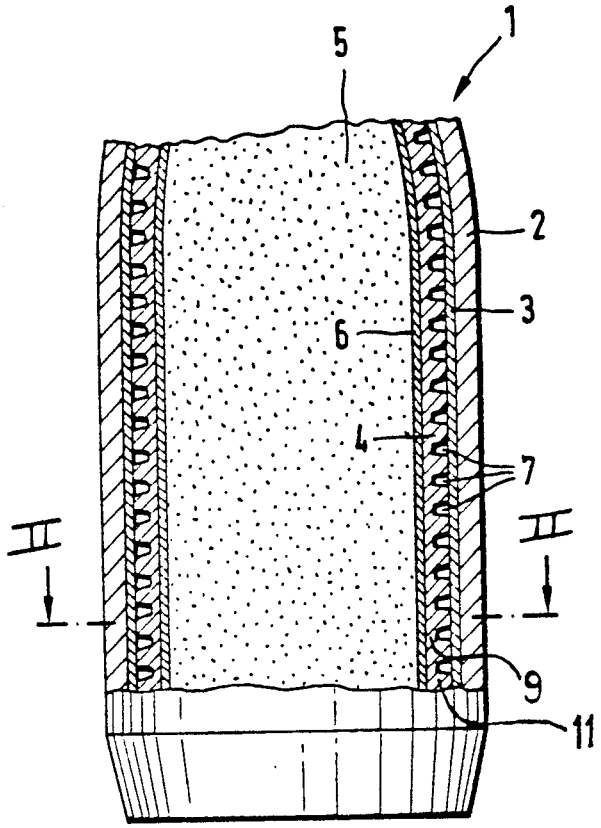
FIG. 1 is a partial sectional view of a portion of a fragmentation projectile, according to a preferred embodiment of the invention in which the explosive is enclosed by three casings.
Figure 2:
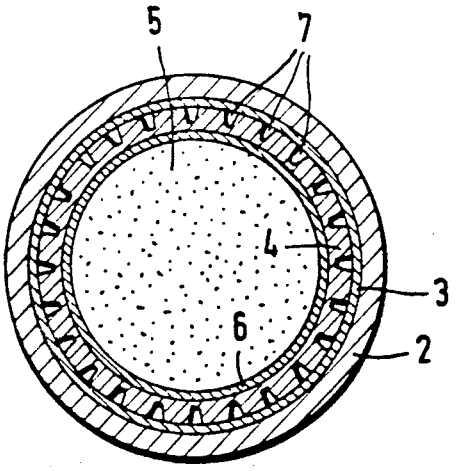
FIG. 2 is a cross section taken along line II—II of the fragmentation projectile of FIG. 1.
Figure 6:
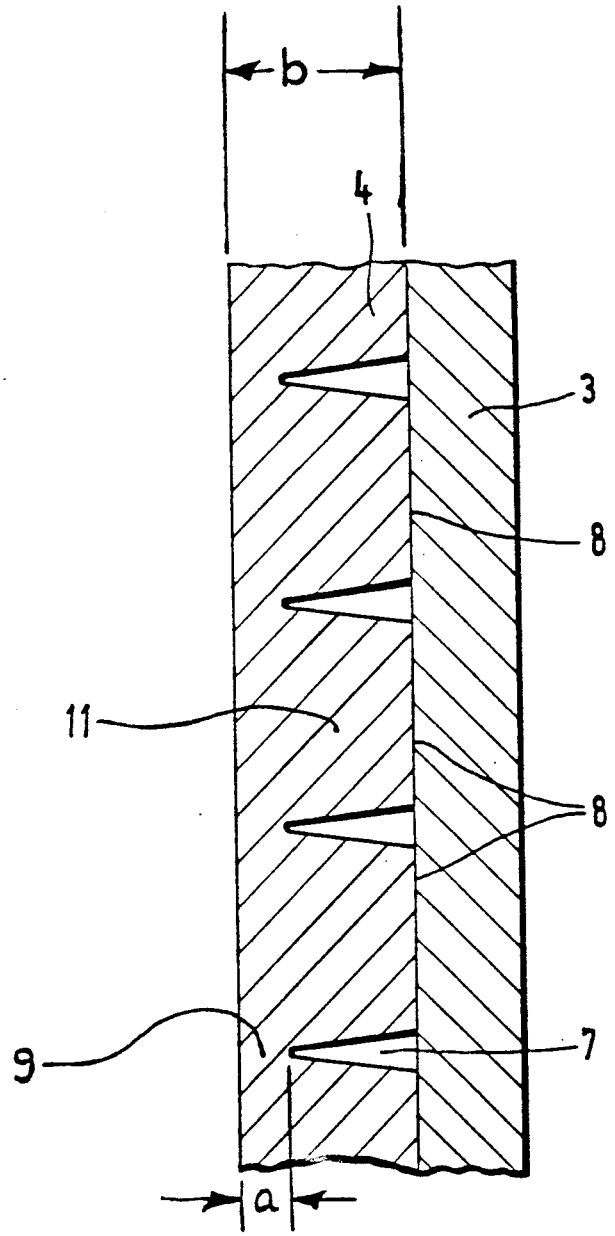
FIG. 6 is a partial sectional view of a portion of an inner casing or shell having structured zones and an adjacent outer shell of the invention, shown on an enlarged scale.

In FIGS. 1 and 2, a fragmentation projectile 1 comprising a plurality of projectile shells is illustrated. The projectile comprises two exterior or outer projectile shells or casings 2 and 3, as well as inner casing or shell 4. The interior of the projectile is filled with an explosive 5 of the fragmentation projectile, and an incendiary material 6 is applied to the inner surface of the inner casing 4. Structured zones 7, e.g. grooves or recesses, preferably are arranged on the surface or side of the inner casing 4 facing away from explosive 5. These structured zones 7 are configured, as can more clearly be seen in FIG. 6, such that at these locations the remaining wall portions 9 of the inner casing 4 have a thickness a which is less than the thickness b of the wall portions 11 of the inner casing 4 surrounding the structured zones 7. Thickness b of casing 4 preferably is substantially constant.

Figure 3:
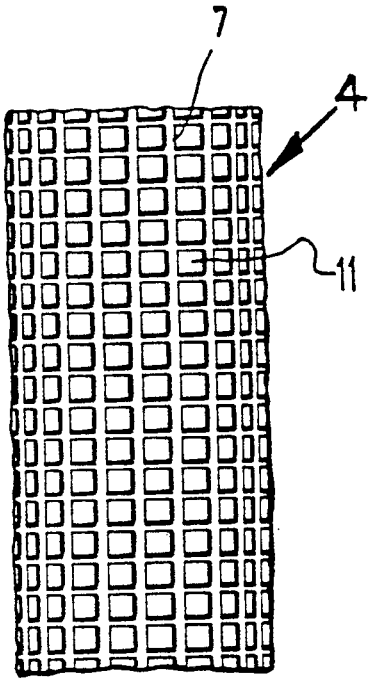
FIG. 3 is a partial plan view of the inner casing or shell having structured zones according to the preferred embodiment of the invention shown in FIG. 1.
Figure 4:
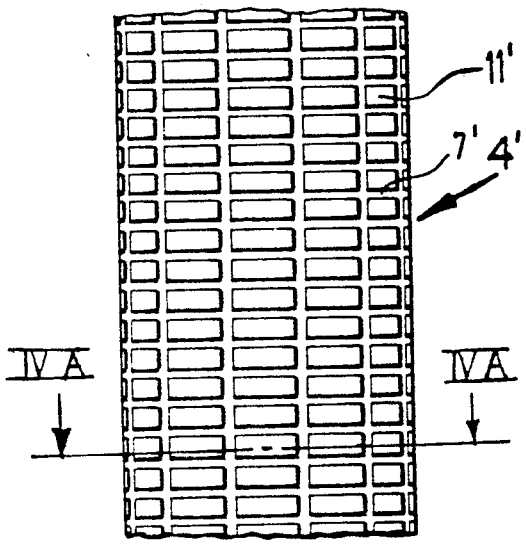
FIG. 4 is a plan view of another embodiment of an inner shell or casing according to the invention showing a different arrangement of the structured zones.
Figure 5:
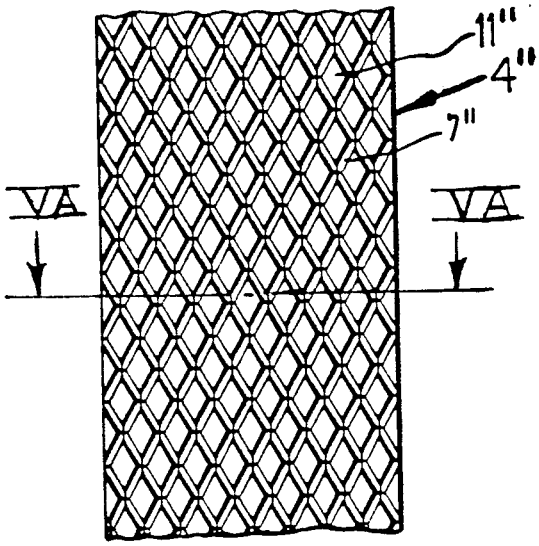
FIG. 5 is a plan view of a further embodiment of an inner shell or casing according to the invention showing still a different arrangement of the structured zones.
Figure 4A:
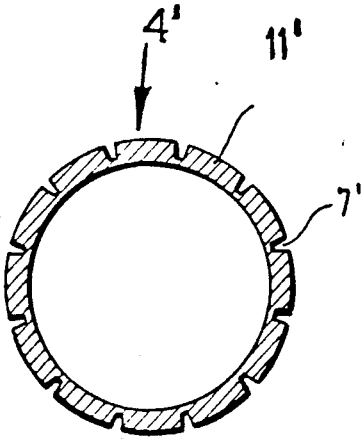
FIG. 4A is a cross section taken along line IVA—IVA of FIG. 4.
Figure 5A:
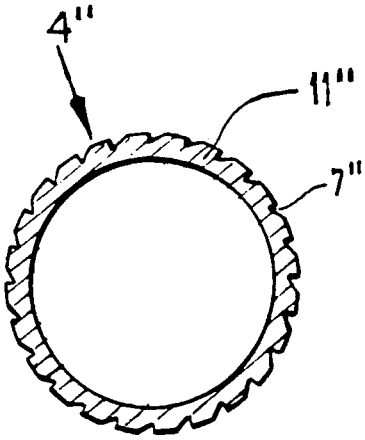
FIG. 5A is a cross section taken along line VA—VA of FIG. 5.

As shown in FIG. 3, the structured zones 7 are preferably a network of grooves formed in the outer surface of casing 4 by a plurality of longitudinally extending grooves and a plurality of parallel circumferentially extending grooves so as to define square portions 11 therebetween. However, the structured zones 7 and the portions 11 therebetween may take different shapes. For example, FIGS. 4 and 4*a*, and FIGS. 5 and 5*a*, show two further embodiments of respective inner casings or shells 4' and 4'', which have respectively different structured zones 7' and 7''. FIG. 4, which is a plan view of inner casing 4', and FIG. 4*a* which is a cross section of the inner casing 4', illustrate a structure distribution such longitudinally and circumferentially extending grooves or zones 7' define portions 11' of casing 4' which exhibit an approximately rectangular configuration. FIGS. 5 and 5*a* show a casing 4'' having structured zones or grooves 7'' which are configured to have sawtooth like shapes (in cross-section) and extend diagonally to the longitudinal axis to the casing 4'' to define portions 11'' with substantially diamond-like shapes.

Turning again to FIG. 6, which is an enlarged partial view of the embodiment of FIG. 1, and shows inner casing or shell 4, structured zones 7, as well as the adjacent outer or exterior shell 3, the function of the invention will be discussed in greater detail below.

In use, projectile 1 can be launched and detonated in a known manner. During the detonation of explosive 5 (FIG. 1), the resulting shock wave impulse is locally directed into and coupled with the outer casing or shell 3 at contact regions 8 between portions 11 in the outer surface of casing 4 and the inner surface of the outer casing 3. In the interior spaces formed by the structured zones or grooves 7, by contrast, no shock wave coupling results, because the corresponding waves are reflected toward air at the interface with the material of the casing 4.

The energy coupled into the outer casing or shell 3 at contact regions 8 accelerates subdomains of the outer shell 3 and induces shear stress gradients in this shell 3. This results in the formation of fragments whose geometries correspond to the pattern of portions 11 defined on inner casing 4.

A steel shell was used as inner shell or casing 4 in one advantageous arrangement, and a material having a higher characteristic acoustic impedance value $\rho \cdot c$ ($\rho$ = density, c = speed of the shock wave effected by the detonation), for example, tungsten or a tungsten heavy material alloy, was used as outer shell 3. As for the outer casing 2 in FIGS. 1-3 no special requirements have to be met as far as the material or acoustic inpedance are concerned.

The outer casing 2 serves as outer protective shell of the projectile 1 and confinement for the high explosive.

Casing 2 is usually made of high strength steel to ensure that the projectile can sustain the forces due to the acceleration when launched.

Casing 3 serves as compensator for the different thermic expansions between the outer protective shell and the inner casings and is intended to ensure that they be kept properly in place.

The sound pressure p for the density waves coupled in at the contact region 8 is given by the equation $$p = \frac{2 \cdot p_o}{1 + (\rho_1 \cdot c_1 / \rho_2 \cdot c_2)}$$

in which:

$p_o$ = sound pressure of the incoming wave;

$\rho_1 \cdot c_1$ = characteristic acoustic impedance of the inner casing; and $\rho_2 \cdot c_2$ = characteristic acoustic impedance of the outer shell.

Then, given that $(\rho_1 \cdot c_1 / \rho_2 \cdot c_2) < 1$ holds for the combination tungsten/steel, p increases. In the case of tungsten or a tungsten heavy metal alloy, briefly exceeding the critical tension values suffices to achieve the desired result, inasmuch as these materials are brittle and prone to rupture. If ductile materials are used for outer casing or shell 3, work of deformation up to the breaking point must additionally be performed.

Fragment shape, fragment size, the number of fragments, as well as fragment speed may be determined by appropriately configuring inner shell 4.

It will be understood that the above description of the present invention is susceptible to various modifications, changes, and adaptations, and the same are intended to be comprehended within the meaning and range of equivalents of the appended claims.

What is claimed is:

1. A fragmentation projectile comprising:

at least two adjacent casings including an inner metal casing having an inner surface and an outer surface, and at least one outer metal casing substantially surrounding said inner casing;

an explosive charge disposed within said inner casing;

an incendiary mass disposed on said inner surface of said inner casing and facing said explosive; and structured zone means, disposed on said outer surface of said inner casing and including regions of lesser wall thickness than the portions of said inner casing between said regions, for causing a shock wave generated when said explosive charge is detonated to be transferred locally into said at least one outer casing to produce fragments of a predetermined size and shape.

2. A fragmentation projectile as defined in claim 1 wherein said inner casing and said outer casing are each formed of respective material having different characteristic acoustic impedances $\rho \cdot c$, and said acoustic impedance of said material of said inner casing is less than said acoustic impedance of said material of said outer casing, where $\rho$ is the density of the respective material, and c is the speed of the shock wave generated in the respective material by the detonation of the explosive charge.

3. A fragmentation projectile as defined in claim 2, wherein said material of said inner casing comprises steel, and said material of said outer casing is one of tungsten and a tungsten heavy metal alloy.

4. A fragmentation projectile as defined in claim 3 further comprising a further casing disposed on and surrounding the outer surface of said at least one outer casing.

5. A fragmentation projectile as defined in claim 4 wherein said further casing is formed of steel.

6. A fragmentation projectile as defined in claim 1, wherein said inner casing has a substantially constant wall thickness and said structured zones means comprise a pattern of grooves formed in said outer surface of said inner casing.

7. A fragmentation projectile as defined in claim 6, wherein said pattern of grooves includes a plurality of parallel circumferentially extending grooves and a plurality of parallel longitudinally extending grooves.

8. A fragmentation projectile as defined in claim 7, wherein said portions of said inner casing between said regions of lesser wall thickness have a square shape at said outer surface of said inner casing.

9. A fragmentation projectile as defined in claim 6, wherein said pattern of grooves includes a plurality of grooves extending diagonally to a longitudinal axis of said projectile such that said portions of said inner casing between said regions of lesser wall thickness have a substantially diamond shape at said outer surface of said inner casing.

10. A fragmentation projectile as defined in claim 7, wherein said portions of said inner casing between said regions of lesser wall thickness have a rectangular shape at said outer surface of said inner casing.

11. A fragmentation projectile comprising:

at least two adjacent casings including an inner casing having a substantially constant wall thickness, an inner surface and an outer surface, and at least one outer casing substantially surrounding said inner casing;

an explosive charge disposed within said inner casing;

an incendiary mass disposed on said inner surface of said inner casing and facing said explosive;

structured zone means, disposed on said outer surface of said inner casing and including regions of lesser wall thickness than the portions of said inner casing between said regions, for causing a shock wave generated when said explosive charge is detonated to be transferred locally into said at least one outer casing to produce fragments of a predetermined size and shape, said structured zone means comprise a pattern of grooves, which have a sawtooth shape in cross-section, formed in said outer surface of said inner casing, said pattern of grooves including a plurality of said grooves extending diagonally to a longitudinal axis of said projectile such that said portions of said inner casing between said regions or lesser wall thickness have a substantially diamond shape at said outer surface of said inner casing.

12. A fragmentation projectile as defined in claim 11 wherein said inner casing and said at least one outer casing are each formed of metal.

13. A fragmentation projectile comprising:

at least two adjacent casings including an inner casing having an inner surface and an outer surface, and at least one outer casing substantially surrounding said inner casing;

an explosive charge disposed within said inner casing;

an incendiary mass disposed on said inner surface of said inner casing and facing said explosive;

structured zone means, disposed on said outer surface of said inner casing and including regions of lesser wall thickness than the portions of said inner casing between said regions, for causing a shock wave generated when said explosive charge is detonated to be transferred locally into said at least one outer casing to produce fragments of a predetermined size and shape; and a further casing disposed on and surrounding the outer surface of said at least one outer casing.

14. A fragmentation projectile or defined in claim 13 wherein said inner casing, said at least one outer casing and said further casing are all formed of metal.

15. A fragmentation projectile as defined in claim 14 wherein said further casing is formed of steel.

* * * * *